US006457747B1

(12) United States Patent
Treleaven et al.

(10) Patent No.: US 6,457,747 B1
(45) Date of Patent: Oct. 1, 2002

(54) HANGER LABEL

(75) Inventors: Carl W. Treleaven, Greensboro, NC (US); Glenn A. Grosskopf, Lake Zurich, IL (US)

(73) Assignee: Pharmagraphics (Southeast) L.L.C., Greensboro, NC (US)

( * ) Notice: Subject to any disclaimer, the term of this patent is extended or adjusted under 35 U.S.C. 154(b) by 0 days.

(21) Appl. No.: 09/528,751

(22) Filed: Mar. 20, 2000

Related U.S. Application Data

(60) Provisional application No. 60/127,345, filed on Apr. 1, 1999.

(51) Int. Cl.[7] ..... B42D 15/00

(52) U.S. Cl. ..... 283/81; 215/399; 283/101; 283/106

(58) Field of Search ..... 283/81, 94, 101, 283/106, 109; 281/2, 5; 215/399; 428/40.1, 41.7, 41.8, 41.9, 42.1, 42.2, 42.3

(56) References Cited

U.S. PATENT DOCUMENTS

| | | | | |
|---|---|---|---|---|
| 2,135,236 | A | 11/1938 | Koppelman | 229/90 |
| 2,362,523 | A | 11/1944 | Armstrong, Jr. et al. | 215/1 |
| 2,635,604 | A | 4/1953 | Fredrickson | 128/272 |
| 3,231,919 | A | 2/1966 | MacDonald | 15/174 |
| 3,387,732 | A | 6/1968 | Jellies | 215/100 |
| 3,623,633 | A | 11/1971 | Kinn | 220/94 R |
| 3,635,367 | A | 1/1972 | Morita et al. | 215/100 A |
| 3,744,658 | A | 7/1973 | Fujio | 215/100 A |
| 3,851,790 | A | 12/1974 | Kasper | 220/85 R |
| 3,869,333 | A | 3/1975 | McMaster | 161/39 |
| 3,884,443 | A | 5/1975 | McMaster | 248/467 |
| 4,306,662 | A | 12/1981 | Sciortino et al. | 215/399 |
| 4,396,128 | A | 8/1983 | Larson et al. | 215/399 |
| 4,460,143 | A | 7/1984 | Ohama | 248/359 |
| 4,462,538 | A | 7/1984 | Gendron | 229/68 R |
| 4,479,838 | A | 10/1984 | Dunsirn et al. | 156/247 |
| 4,539,766 | A | 9/1985 | Fast | 40/22 |
| 4,779,367 | A | 10/1988 | Fast | 40/657 |
| 4,796,937 | A | 1/1989 | Andrea | |
| 4,832,301 | A | 5/1989 | Hiramoto et al. | 248/359 |
| 4,847,130 | A | 7/1989 | Cooper | 428/40 |
| 4,948,000 | A | 8/1990 | Grabenkort | 215/12.2 |
| 5,135,125 | A | 8/1992 | Andel et al. | 215/100 |
| 5,238,720 | A | 8/1993 | Volkman | 428/40 |
| 5,290,083 | A | 3/1994 | Rissley | 294/87.2 |

(List continued on next page.)

FOREIGN PATENT DOCUMENTS

| | | |
|---|---|---|
| DE | 408 315 | 11/1966 |
| DE | 28 06 391 A1 | 8/1978 |
| DE | 3631-021 A | 3/1988 |
| DE | 43 21 572 A1 | 1/1995 |
| EP | 0 390 952 B1 | 6/1994 |
| EP | 0 356 574 B1 | 11/1994 |
| FR | 1.460.738 | 10/1966 |
| GB | 1175296 | 12/1969 |
| GB | 1309950 | 3/1973 |
| WO | WO/9742089 | * 11/1997 |

*Primary Examiner*—A. L. Wellington
*Assistant Examiner*—Monica Carter
(74) *Attorney, Agent, or Firm*—Myers Bigel Sibley & Sajovec

(57) ABSTRACT

A hanger label for use with an intended substrate and a support includes a hanger member. The hanger member includes an attachment portion having a lower surface and a hanger portion having a lower surface. The hanger portion defines an opening adapted to receive the support. A first, permanent adhesive coats the lower surface of the attachment portion to substantially permanently adhere the attachment portion to the substrate and a second, non-permanent adhesive coats the lower surface of the hanger portion to temporarily adhere the hanger portion to the substrate. Alternatively, a second, permanent, patterned adhesive may partially coat the hanger portion to temporarily adhere the hanger portion to the substrate. A base label may be provided.

26 Claims, 11 Drawing Sheets

U.S. PATENT DOCUMENTS

| | | | | | |
|---|---|---|---|---|---|
| 5,350,612 | A | | 9/1994 | Stern et al. | 428/40 |
| 5,417,365 | A | | 5/1995 | Lindsay | 229/117 |
| 5,490,658 | A | | 2/1996 | Coward et al. | 248/683 |
| 5,542,634 | A | | 8/1996 | Pomerantz | 248/214 |
| 5,605,730 | A | * | 2/1997 | Treleaven | 281/2 |
| 5,736,212 | A | * | 4/1998 | Fischer | 281/4 |
| 5,738,381 | A | | 4/1998 | Treleaven et al. | 283/81 |
| 5,782,495 | A | | 7/1998 | Grosskopf et al. | 281/81 |
| 5,823,503 | A | | 10/1998 | Wasserman | 248/683 |
| 5,829,788 | A | | 11/1998 | Jackson | 283/81 |
| 5,878,901 | A | | 3/1999 | Grosskopf et al. | 215/399 |
| 6,000,726 | A | * | 12/1999 | Campbell | 283/101 |
| 6,015,470 | A | | 1/2000 | Treleaven et al. | 156/267 |
| 6,082,777 | A | * | 7/2000 | Grosskopf et al. | 215/12.1 |
| 6,102,441 | A | * | 8/2000 | Treleaven et al. | 215/399 |
| 6,110,553 | A | * | 8/2000 | Grosskopf et al. | 215/399 |
| 6,190,747 | B1 | * | 2/2001 | Fischer | 281/4 |
| 6,328,340 | B1 | * | 12/2001 | Fischer | 283/101 |

* cited by examiner

HANGER LABEL

RELATED APPLICATION

This application claims the benefit of U.S. Provisional Application No. 60/127,345 filed Apr. 1, 1999.

FIELD OF THE INVENTION

The present invention is directed to hangers and labels having hangers for suspending goods or packaging.

BACKGROUND OF THE INVENTION

In administering certain medicines and pharmaceuticals, it is necessary to suspend a bottle or other package containing the pharmaceutical product from a hanger or like support. In particular, intravenously administered fluids are typically contained in a bottle which is suspended from an extended hanger to provide gravity induced flow of the fluid. It may be desirable to suspend articles other than medical and pharmaceutical bottles as well.

SUMMARY OF THE INVENTION

Generally, the present invention is directed to a hanger and a label incorporating the same which provides enhanced reliability, performance and usability, as well as improved convenience and cost-effectiveness in manufacture and handling.

The label may include a hanger having a folded configuration which allows the label to be unfolded from a relatively compact stored position to a relatively long hanging position.

The label may include a hanger having at least one attachment portion and a hanging portion defining an opening for receiving a support. The attachment portion is coated with a substantially permanent first adhesive suitable to securely adhere the attachment portion to an intended substrate. The intended substrate may be an article such as an IV bottle or the intended substrate may be a base label. The hanging portion of the hanger is coated with a less adherent, non-permanent second adhesive. The second adhesive is effective to temporarily adhere the hanging portion to the intended substrate, but allows the hanging portion to be pulled away from the substrate, preferably without damaging the substrate, when the user desires to employ the hanger. More preferably, the second adhesive is a "fugitive adhesive" which adheres to the intended substrate but which, upon removal from the substrate, becomes substantially non-adherent.

The label may include a base label having a lower surface, a base adhesive disposed on the lower surface for affixing the label to a substrate, and a hanger as described above. The hanger may have two or more interconnected legs defining an opening therebetween, each of the legs having a respective end, each of the ends of the legs being adhered to the base label.

The hanger may be foldable about the ends between a stored position wherein the hanger lies adjacent an upper surface of the base label and a hanging position wherein the hanger is folded away from the base label for receiving the support through the opening.

The hanger may include first and second superimposed layers. Preferably, each of the first and second layers is formed of polymeric film. Each of the first and second layers is preferably substantially transparent.

The ends of the legs may be secured to an upper surface of the base label by an anchoring adhesive. Further, each of the first and second layers may extend beyond the hanger with the hanger defined by cut lines formed through the first and second layers.

The base label may have an upper surface with indicia disposed on the upper surface of the base label. Moreover, at least a portion of the indicia may underlie the hanger when the hanger lies adjacent the upper surface of the base label in a stored position. Preferably, each of the layers of the hanger is formed from a transparent material, whereby the indicia is visible through the hanger when the hanger is in the stored position.

The present invention is further directed to a method for forming a label as described above for displaying information regarding a container and suspending the container from a support.

The present invention is further directed to a hanger as described above.

Objects of the present invention will be appreciated by those of ordinary skill in the art from a reading of the Figures and the detailed description of the preferred embodiments which follow, such description being merely illustrative of the present invention.

DETAILED DESCRIPTION OF THE PREFERRED EMBODIMENTS

Figure 1:
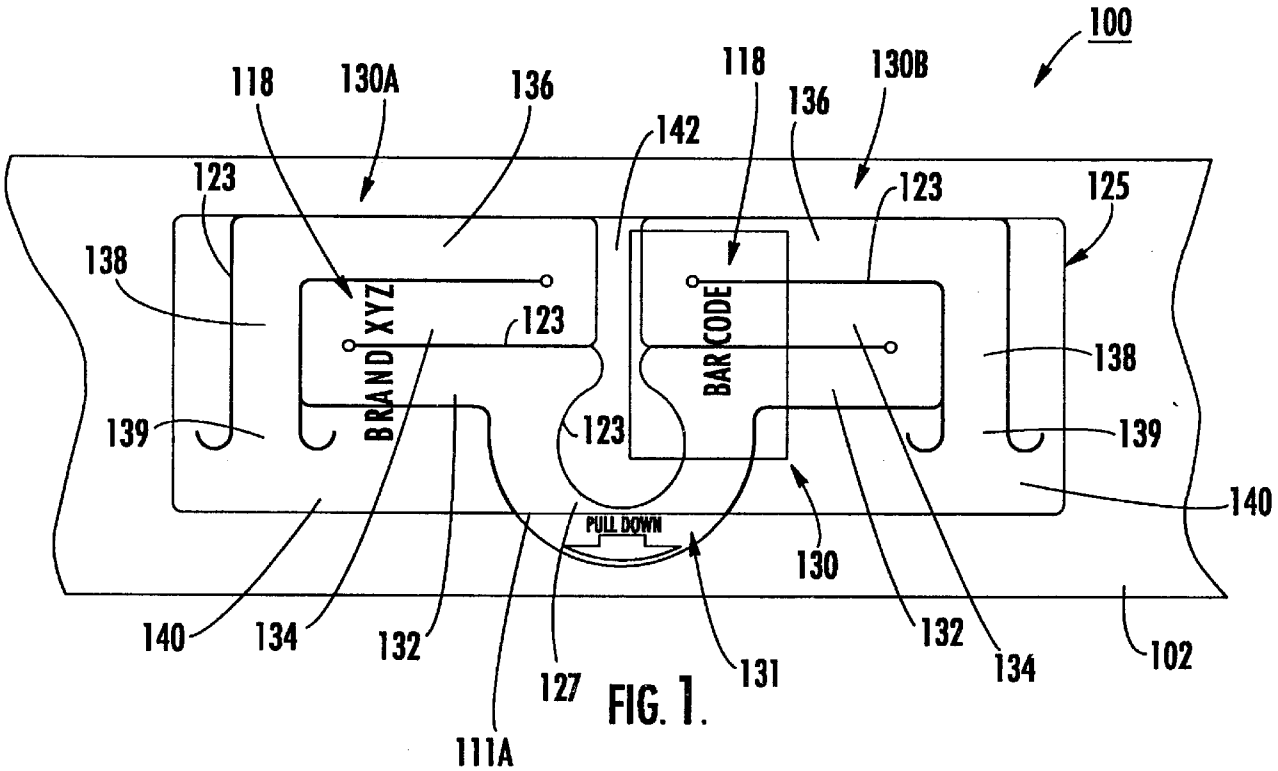
FIG. 1 is a top plan view of a label according to the present invention disposed on a release liner.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. The thicknesses of layers of the labels as shown in the drawings may be exaggerated for clarity.

Figure 2:
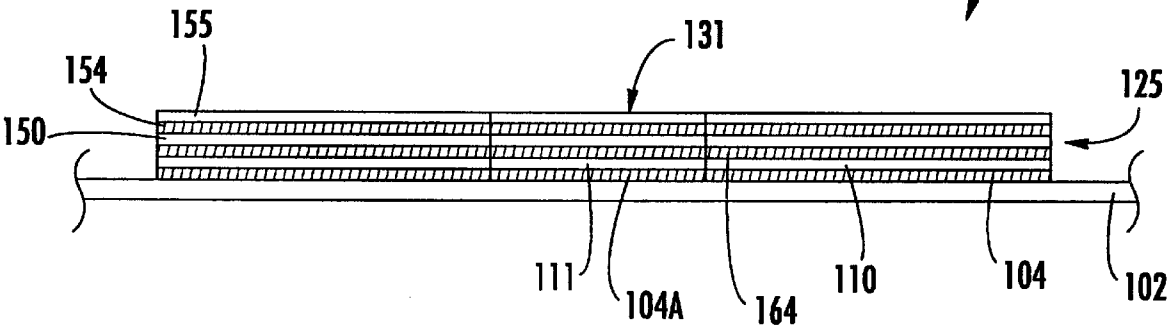
FIG. 2 is a side elevational view of the label of FIG. 1 disposed on the release liner.
Figure 3:
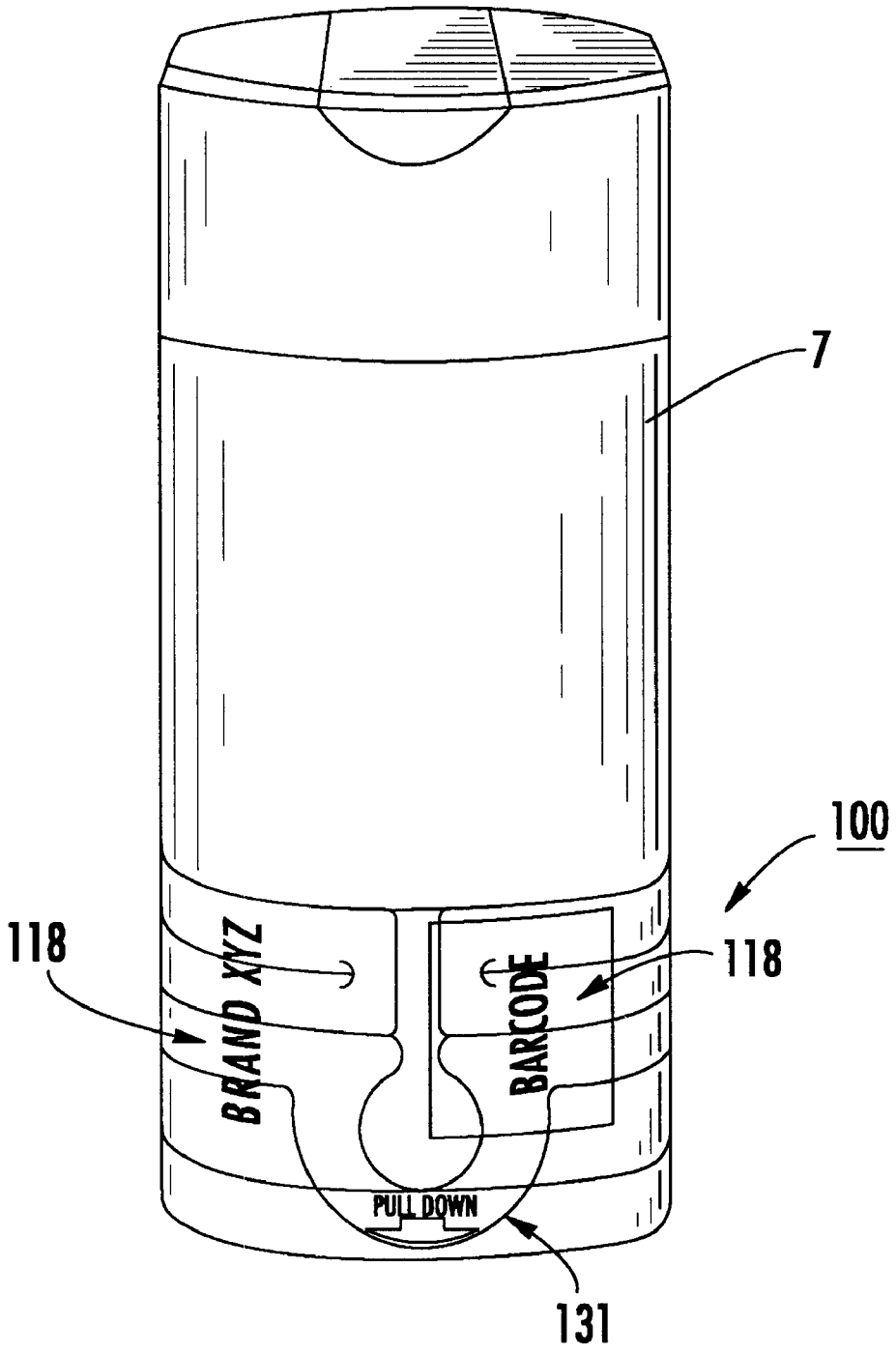
FIG. 3 is a perspective view of the label of FIG. 1 mounted on a container with a hanger thereof in a stored position.
Figure 4:
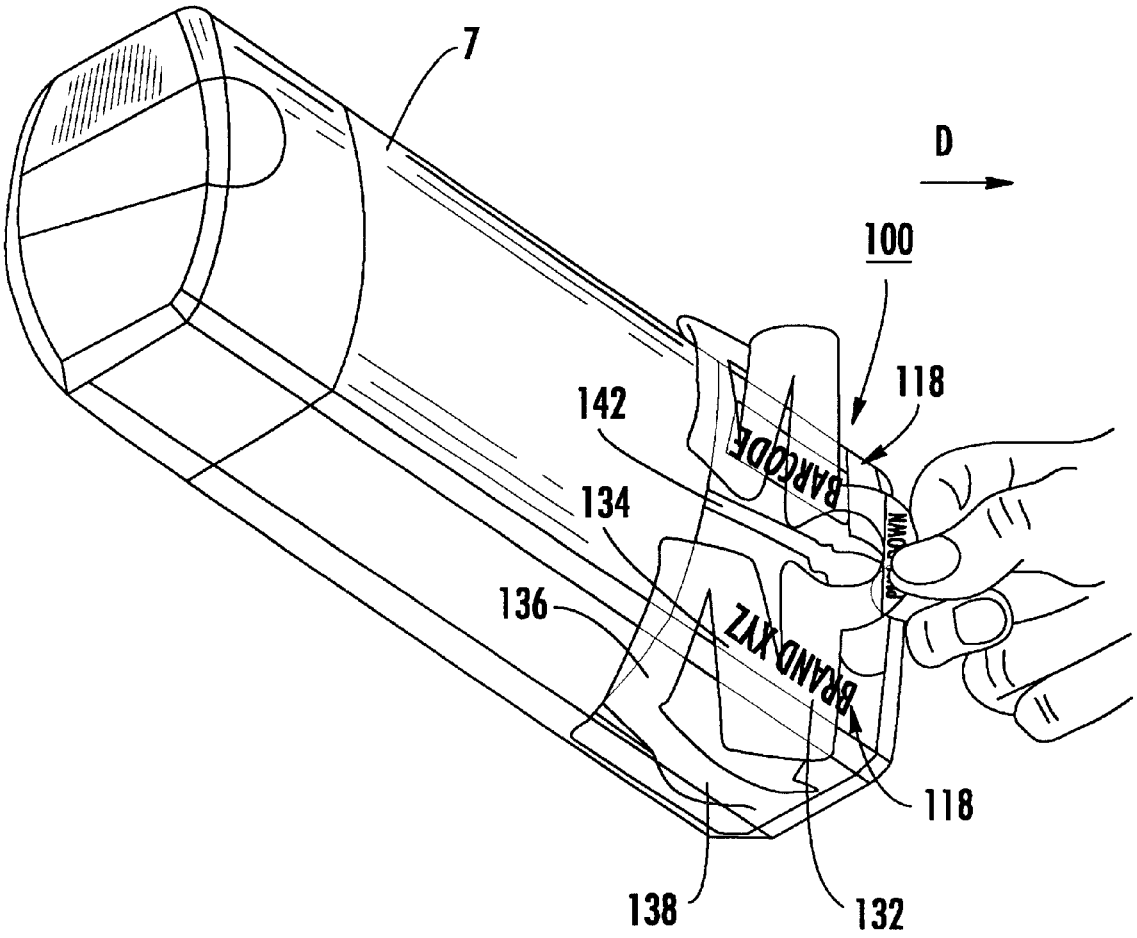
FIG. 4 is a perspective view of the label of FIG. 1 mounted on the container with the hanger thereof partially unfolded.
Figure 5:
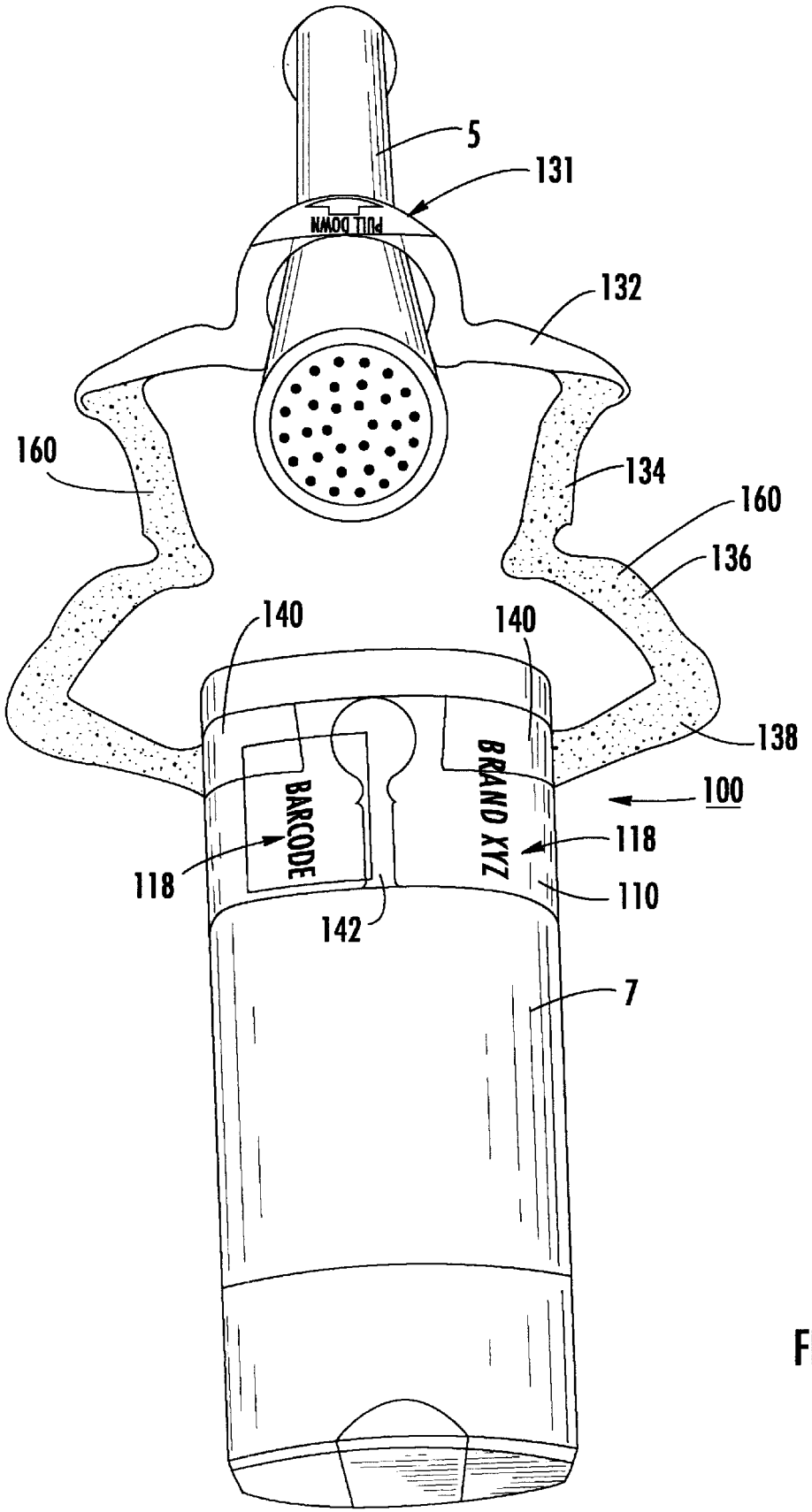
FIG. 5 is a perspective view of the label of FIG. 1 mounted on the container with the hanger thereof in a hanging position.

With reference to FIGS. 1–6, a label 100 according to the present invention is shown therein. As shown in FIGS. 1 and 2, the label 100 is initially releaseably secured to a release liner 102 by an adhesive layer 104. The label 100 may be removed from the release liner 102 and applied to a suitable container 7 as shown in FIG. 3 by conventional means including, for example, automatic applicator equipment. Once affixed to the container 7 by means of the adhesive 104, the label 100 will serve by means of indicia 118 to display information regarding the container 7 and its contents. The indicia 118 may include a bar code or other coded identifier as well as lot and expiration date data. Further, a hanger 130 forming a part of the label 100 may be unfolded from a base label 110 forming a part of the label 100 (as shown in FIG. 4) and looped over a suitable support 5 for suspending the container 7 (as shown in FIG. 5).

Turning to the label 100 in greater detail, the base label 110 may be formed from any suitable film or paper stock. Further, the base label 110 may be formed from a self adhesive pressure sensitive web or, as an alternative, the pressure sensitive material may be applied to the undersurface of the stock or to the upper surface of the release liner, the release liner and stock thereafter being married. The adhesive 104 is preferably a permanent pressure sensitive adhesive suitable to secure the base label 110 to the intended article such that removal of the base label 110 from the article will result in damage to the article, the base label 110 or both. Suitable materials for the base label 110 include 2.3 mil white biaxially oriented polypropylene face stock with B-122 adhesive (corresponding to the adhesive 104) and a 50 pound release liner (corresponding to the release liner 102), available from Brownbridge Industries, Inc. of Troy, Ohio. Suitable indicia 118 such as brand names, bar codes, warnings, and lot and expiration data are printed on the upper surface of the base label 110. A tab 111 extends from an edge of the base label 110 and forms a part of a pull tab 131 of the hanger 130. The indicia 118 is printed on the base label 110.

The label 100 further includes a hanger member 125. The hanger member 125 is formed of superimposed layers 150 and 155 which are permanently secured to one another by adhesive 154. The layer 150 is formed of a relatively tear resistant, high strength material as compared to the layer 155. The layer 155 is formed of a relatively stretch resistant material as compared to the layer 150. The positions of the layers 150 and 155 may be reversed, however, the order as described and shown is preferred. In place of or in addition to the indicia 118, indicia (not shown) may be printed on the hanger member 125, including on the hanger 130.

Preferably, each of the layers 150 and 155 is transparent. The layer 155 is preferably a polyester film having a thickness of from about 2 to 6 mil, and more preferably from about 3 to 4 mil. Suitable polyester films are available from Fasson of Painesville, Ohio. The layer 150 is preferably a high density polyethylene film having a thickness of from about 2 to 5 mil, and more preferably no greater than 2.5 mil (as discussed in more detail below). More preferably, the layer 150 is an oriented and cross-laminated high density polyethylene film having such thickness. Suitable oriented and cross-laminated high density polyethylene films for the layer 150 include VALERON® film available from Van Leer Films. Suitable adhesives for the adhesive 154 include S3000 available from Fasson.

As noted above, the layers 150 and 155 are preferably transparent. If the layer 150 is formed of high density polyethylene, it has been found that the material may be rendered substantially transparent by selectively heating and stretching (simultaneously in both the machine and transverse directions) an originally cross laminated film of a prescribed thickness to a thickness of about 2.5 mil or less. It has been found that films processed in this manner but having a final thickness of greater than about 2.5 mil are not substantially transparent. Further, it has been found that two or more stacked film layers processed in this manner and each having a thickness of about 2.5 mil or less, but having a combined thickness of greater than 2.5 mil, also do not provide a substantially transparent construction. Accordingly, if the layer 150 is a high density polyethylene film, the layer 150 should be no greater than about 2.5 mil thick and should be formed of a unitary layer. Transparent polyester films are commonly available in a wide range of thicknesses.

Preferably, the layers 150 and 155 are of the same size and shape with their respective peripheries in registry as shown, however, the layers may be differently configured. Preferably, the adhesive 154 completely coats the opposed surfaces of the layers 150, 155. Thus, the hanger 130 is dual ply throughout. The preferred dimensions of the layers 150, 155 will depend upon the particular application and the desired appearance of the hanger.

The hanger member 125 is secured to the upper surface of the base label 110 by a first, permanent adhesive layer 164 which coats an attachment portion of the lower surface of the layer 150 and also by a second, temporary adhesive layer 160 (see FIGS. 5 and 6) which coats a hanger portion of the lower surface of the layer 150. A pattern of diecuts 123 is formed through the layers 150, 154, 155 and defines the hanger 130 and attachment portions 140 and a central portion 142 (i.e., the remainder of the hanger member 125 not forming a part of the hanger 130). The hanger 130 includes interconnected strips 132, 134, 136, 138, which form legs 130A and 130B, and a loop 127. The strips 138 terminate at respective ends 139 which are preferably formed with stress relief curves as shown.

Preferably, the adhesive 164 underlies the entireties of the attachment portions 140 and the central portion 142. Preferably, the adhesive 164 is a permanent pressure sensitive adhesive such that removal of these portions 140, 142 from the base label 110 will result in damage to the base label 110, the portions 140, 142 or both. In any event, the adhesive 164 is preferably sufficiently adherent to the base label 110 to support the expected load of the container 7 and its contents. Suitable permanent adhesives include S3000 available from Fasson of Painesville, Ohio.

Preferably, the adhesive layer 160 underlies the entirety of the hanger 130. The adhesive 160 is an adhesive of the type commonly referred to as a "fugitive adhesive". Such adhesives are characterized in that they are operative to adhere two layers (in this case, the portion of the layer 150 within the hanger 130 and the upper surface of the base label 110) but, when the two layers are separated, the exposed adhesive 160 is substantially non-adherent. When the adhesive dries, the bond will remain strong enough to hold the layers together until the bond is broken by deliberately separating the layers. The adhesive is then dry and tackless (i.e., at least nontacky to the touch) and will not adhere to anything or unduly collect dirt and debris. Preferably, the materials of the layers 150 and 110 and the adhesive 160 are chosen such that the adhesive 160 will remain with the underside of the hanger 130, however, it is also contemplated that the adhesive 160 may remain with the underlying upper surface of the base label 110. The particular characteristics of the adhesive will depend on the materials chosen for the layers to be bonded as well as the required performance parameters (e.g., the desired amount of force required to break the bond between the layers). Suitable adhesives include WB4738 available from H. B. Fuller of St. Paul, Minn. Preferably, the adhesive 160 is substantially transparent so that indicia beneath the hanger 130 may be viewed. An alternative suitable adhesive is described in U.S. Pat. No. 4,479,838 to Dunsirn et al., the disclosure of which is incorporated herein by reference.

The pull tab 131 includes portions of the layers 150, 154, 155 as well as a base tab 111. The base tab 111 is coextensive with the pull tab 131 and extends beyond the lower edge of the base label 110. The base tab 111 is separated from the remainder of the base label 110 by a cut line 111A (which extends up to the adhesive layer 164) and is adhered to the underside of the pull tab 131 by a portion of the pressure sensitive adhesive 164. The underside of base tab 111 is coated with pressure sensitive adhesive 104A which has been deadened by an adhesive deadener or varnish. Suitable adhesive deadeners and varnishes include Radcure 800 available from Radcure Corporation of Livingston, N.J. Preferably, suitable indicia such as "PULL DOWN" is printed on the upper surface of the base tab 111 and is visible through the layers 150, 154, 155 of the pull tab 131.

While in the preferred embodiment the hanger 130 is substantially entirely coated with the adhesive 160, it may be desirable in some instances to only partially coat the hanger 130 with the adhesive 160. For example, the adhesive 160 may be provided in discrete spots (not shown).

From the foregoing, it will be appreciated that when the label 100 is removed from the release liner, the deadened adhesive 104A will readily separate from the release liner. Once the label 100 is affixed to a desired container 7 by means of the adhesive 104, the pull tab 131 may be lifted away to employ the hanger 130, the deadened adhesive 104A not forming a bond with the container. It will be appreciated that, because the periphery of the pull tab 131 is free and not surrounded by a layer of film or the like, that the pull tab 131 is easily accessible for lifting by the user. In particular, the base tab 111 secured to the pull tab 131, and otherwise free of the label and the container, spaces the pull tab 131 somewhat from the surface of the container so that it is even more easily accessible. Methods for forming the described pull tab construction will be apparent to those of skill in the art from a review of U.S. Pat. No. 5,738,381 to Treleaven et al., the disclosure of which is hereby incorporated herein in its entirety.

Alternatively, the pull tab 131 may be formed such that the base tab 111 remains with the base label 110. In such case, the lower surface of the layer 150 in the pull tab 131 is preferably coated with the temporary adhesive 160 and the cut line 111A is not present.

While the label 100 is disposed on the release liner 102, while the label 100 is being applied to the container 7, and while the label 100 is mounted on a container prior to hanging the container, the temporary adhesive 160 holds the hanger 130 down onto the base label 110. In this way, the hanger 130 is prevented from interfering with the handling of the container or extending away from the container where the hanger 130 may be damaged.

Figure 6:
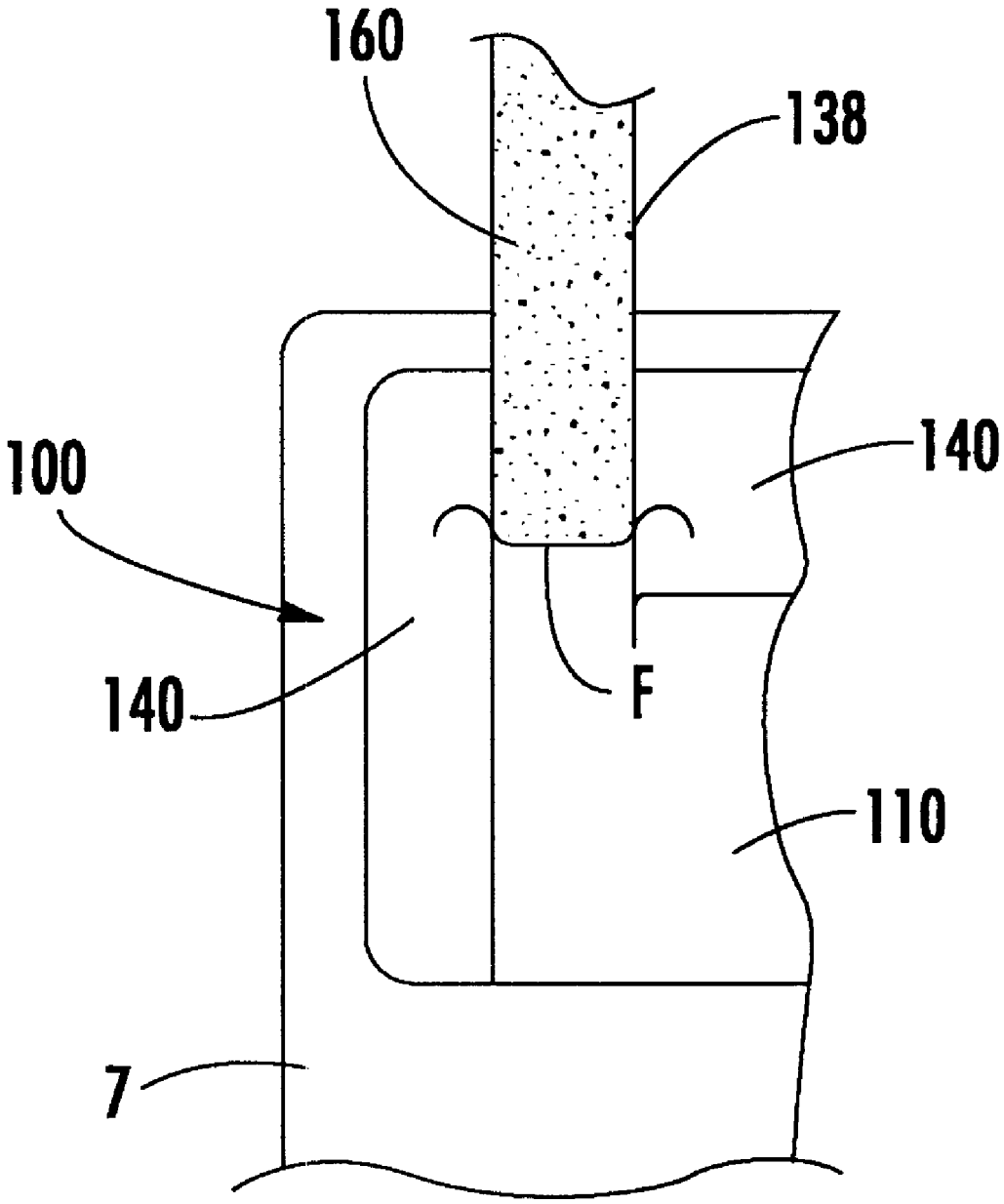
FIG. 6 is an enlarged, fragmentary, front plan view of the label of FIG. 1 mounted on the container with the hanger thereof in the hanging position.

When it is desired to use the label 100 to suspend the container 7, the hanger 130 (including all of its layers 150, 154, 155) may be transitioned from the stored position of FIG. 3 to the hanging position of FIGS. 5 and 6 by grabbing the pull tab 131 and pulling the hanger 130 in a downward direction D (see FIG. 4). The releasable adherence between the hanger 130 and the upper surface of the base label 110 allow the user to easily peel the hanger 130 away from the base label 110. The legs 130A and 130B unravel or unfold as shown and then fold about the ends 139 as the strips 138 separate from the base label 100. Notably, because of the provision of the fugitive adhesive 160, the now exposed adhesive 160 is not adherent or tacky and therefore will not interfere with use of the hanger 130 or the container 7.

The configuration of the legs 130A, 130B provides enhanced strength and durability. As best seen in FIG. 6, because the deployed legs 130A, 130B fold about a fold line F transverse to the gravitational load of the container 7, the load is evenly distributed and localized stresses where the hanger 130 joins the remaining portions 140 are minimized. Stress relief curves in the cut lines further serve to evenly distribute the stresses at the ends of the legs. The distance between the ends of the legs is preferably chosen such that the ends will be disposed diametrically opposite one another when the label is affixed to a container of a prescribed circumference. Stress relief diecut curves serve to inhibit the material of the hanger member 125 from tearing.

Figure 7:
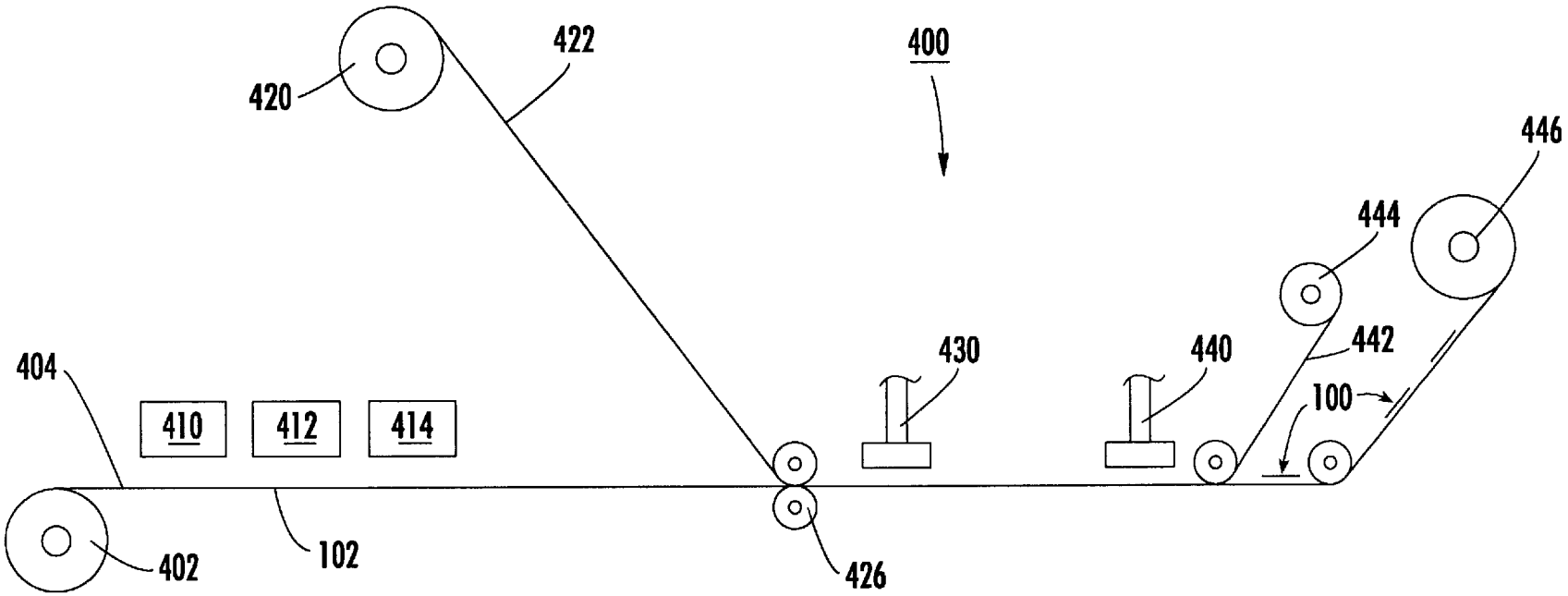
FIG. 7 is a schematic diagram of an apparatus for forming the label of FIG. 1.

With reference to FIG. 7, an apparatus 400 for forming labels 100 according to the first embodiment is shown schematically therein. The apparatus 400 may include, for example, a Mark Andy 2200 Flexopress available from Mark Andy, Inc. of Chesterfield, Mo. Alternatively, rotary letter press, lithographic printing, silk screen, or gravure may be used.

First, a base web of pressure sensitive film or paper 404 is unwound from an unwind station 402. Preferably, the web 404 includes a release liner and a stock web adhered thereto by a pressure sensitive adhesive. Alternatively, the base web 404 may be formed by applying adhesive to the underside of a stock web on line prior to marrying the stock web to the release liner. The stock material and pressure sensitive adhesive correspond to the base label 110 and the adhesive 104 of the finished labels 100. The web 404 is passed through one or more print stations 410 at which indicia 118 is applied to the upper surface of the web.

An adhesive applicator 412 applies adhesive corresponding to the temporary adhesive 160 to the upper surface of the web 404 in locations corresponding to the hanger 130. The adhesive 160 may be applied to the web 404 in a fluid state and then converted to a solid by heat, cooling, radiation or chemical reaction. An adhesive applicator 414 applies adhesive corresponding to the permanent adhesive 164 to the upper surface of the web 404 in locations corresponding to the attachment portions 140 and the central portion 142. The adhesive applicators 412, 414 are preferably screen coaters as available from Nordson Corporation of Alpharetta, Ga.

A pre-formed composite web 422 is unwound from an unwind station 420. The web 422 corresponds to the hanger 130, the attachment portions 140, and the central portion 142 of the label 100. The web 422 is formed of (1) an upper continuous web of polyester or other suitable material as described above for the layer 155 and (2) a lower continuous web of VALERON® or other suitable material as described above for the layer 150, secured together by (3) a layer of adhesive therebetween corresponding to the adhesive 154.

The webs 422 and 404 are married at nip rollers 426. Thereafter, a die cutter 430 forms cut lines in the web 422 through each of the lower and upper webs and adhesive (corresponding to the layers 150, 155 and the adhesive 154) down to the base web 404 to define the hanger 130, the attachment portions 140, and the central portion 142.

Thereafter, the labels 100 are formed by a die cutter 440 which forms die cuts through the base web 404, the composite web 422 and the adhesive layers down to the release liner 102. The waste matrix 442 of the base web 404, the web 422 and the adhesive layers is removed by a winding station 444. The resulting labels 100 disposed on the release liner 102 may thereafter be wound onto a winding station 446 or sheeted and stacked.

Each of the labels as described above may be produced "multiple up" on a web. That is, a plurality of labels may be formed across a relatively wide web which may thereafter be slit into individual webs.

Either the upper surfaces or the lower surfaces of each of the layers of the hangers may be printed on. As noted above, each layer of the hanger material is preferably transparent. In this way, if the hanger is not printed, the base label may be printed without regard for the placement of the hanger in either of the stored or operative positions.

From the foregoing, it will be appreciated by those of ordinary skill in the art that labels 100 may be constructed according to other methods.

Additionally, the hanger and method for forming the same may be modified according to the various embodiments described in Applicant's U.S. patent application Ser. No. 08/803,945, filed Feb. 21, 1997, which issued as U.S. Pat. No. 5,878,901 on Mar. 9, 1999, the disclosure of which is hereby incorporated herein in its entirety. For example, the hanger member 125 may be formed of three or more film layers and/or may include a scrim layer as described in application Ser. No. 08/803,945.

Figure 8:
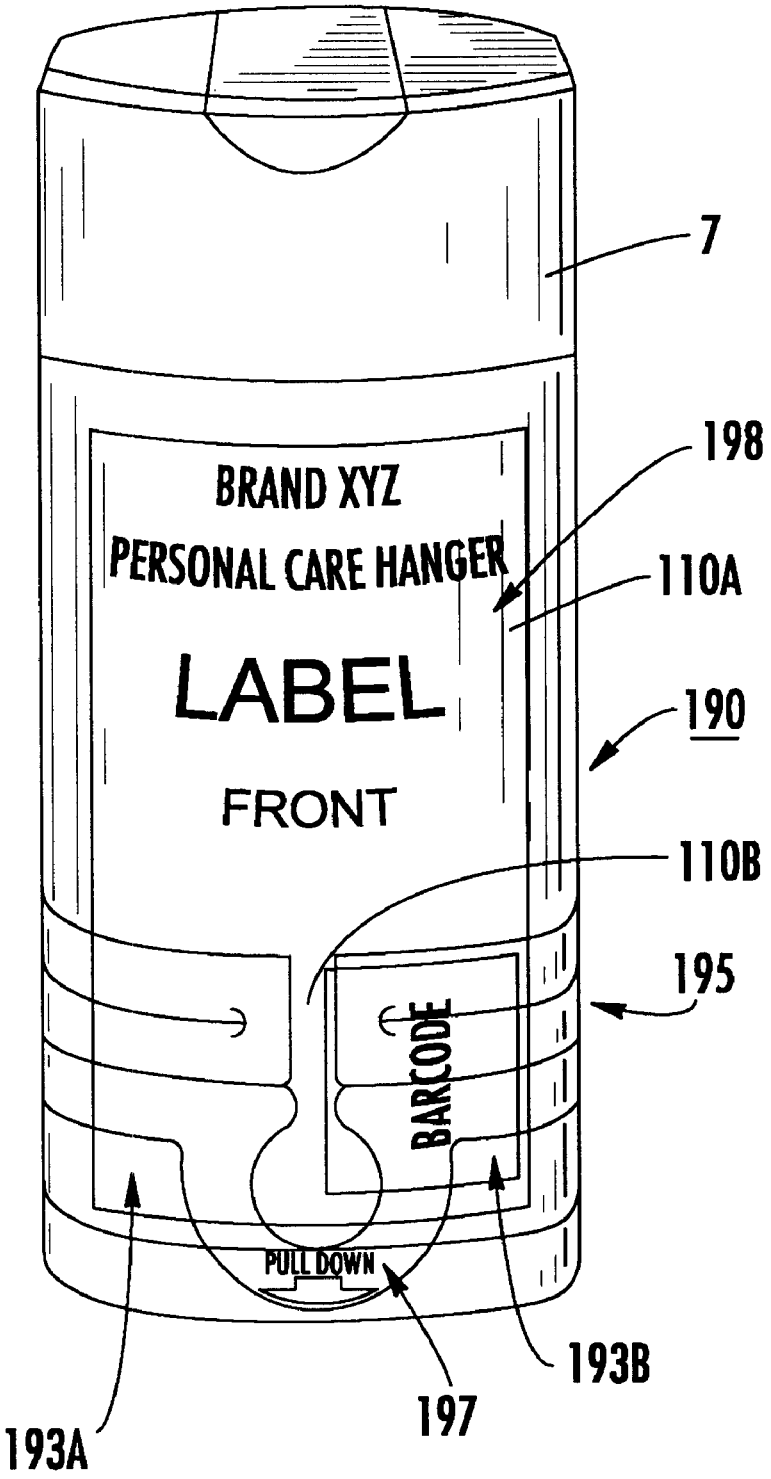
FIG. 8 is a perspective view of a label according to a further embodiment mounted on a container with the hanger thereof in a stored position.

With reference to FIG. 8, a label 190 according to a further embodiment of the present invention is shown therein. The label 190 corresponds to the label 100 except that it is formed such that the central portion of the hanger member 195 corresponding to the hanger member 125 is removed, leaving the upper surface of the base label exposed in the region 110B between the folded hanger legs 193A, 193B and within the loop 197. Also, the base label includes an extended portion 110B extending beyond the upper edge of the hanger member 195. The portion 110B bears indicia 198 and is coated on its rear surface with a permanent adhesive. Suitable modifications to the label and the method for forming the label will be apparent to those of ordinary skill in the art in view of the description herein and the disclosure of U.S. Pat. No. 5,738,381 to Treleaven et al.

Figure 9:
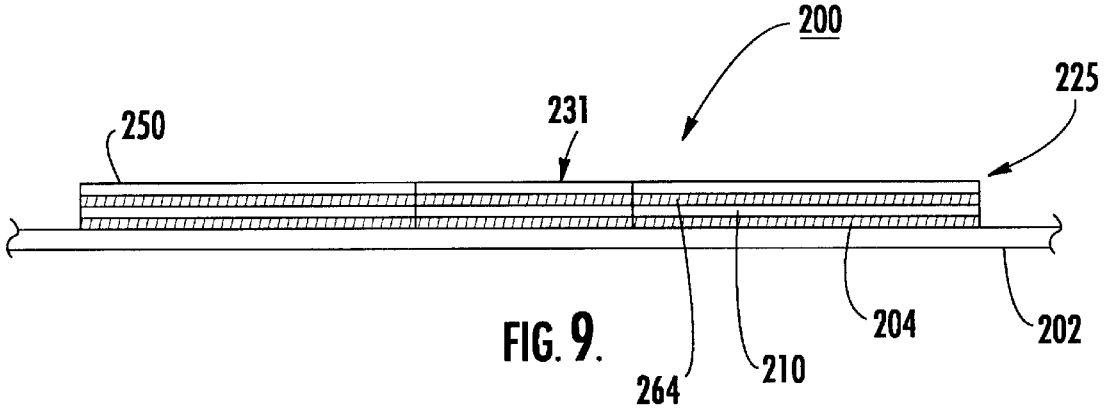
FIG. 9 is a side elevational view of a label according to a further embodiment mounted on a release liner.

A label according to a further embodiment is shown in FIG. 9 and generally designated 200. The label 200 is mounted on a release liner 202 and has a base label 210 releaseably secured to the release liner 202 by an adhesive layer 204 corresponding to the adhesive layer 104. The label 200 differs from the label 100 in that the hanger member 225 includes only a single film layer 250 corresponding to the layer 150 and no layers corresponding to layers 154 and 155 are provided. The layer 250 is secured to the upper surface of the base label 210 by an adhesive layer 264 corresponding to the adhesive layer 164 and a temporary adhesive (not shown) corresponding to the temporary adhesive 160. Each layer is diecut in the same manner as in the label 100 so that the label 200 and the hanger thereof will have the same configurations as shown in FIG. 1 as well as a pull tab 231 corresponding to the pull tab 131.

Figure 10:
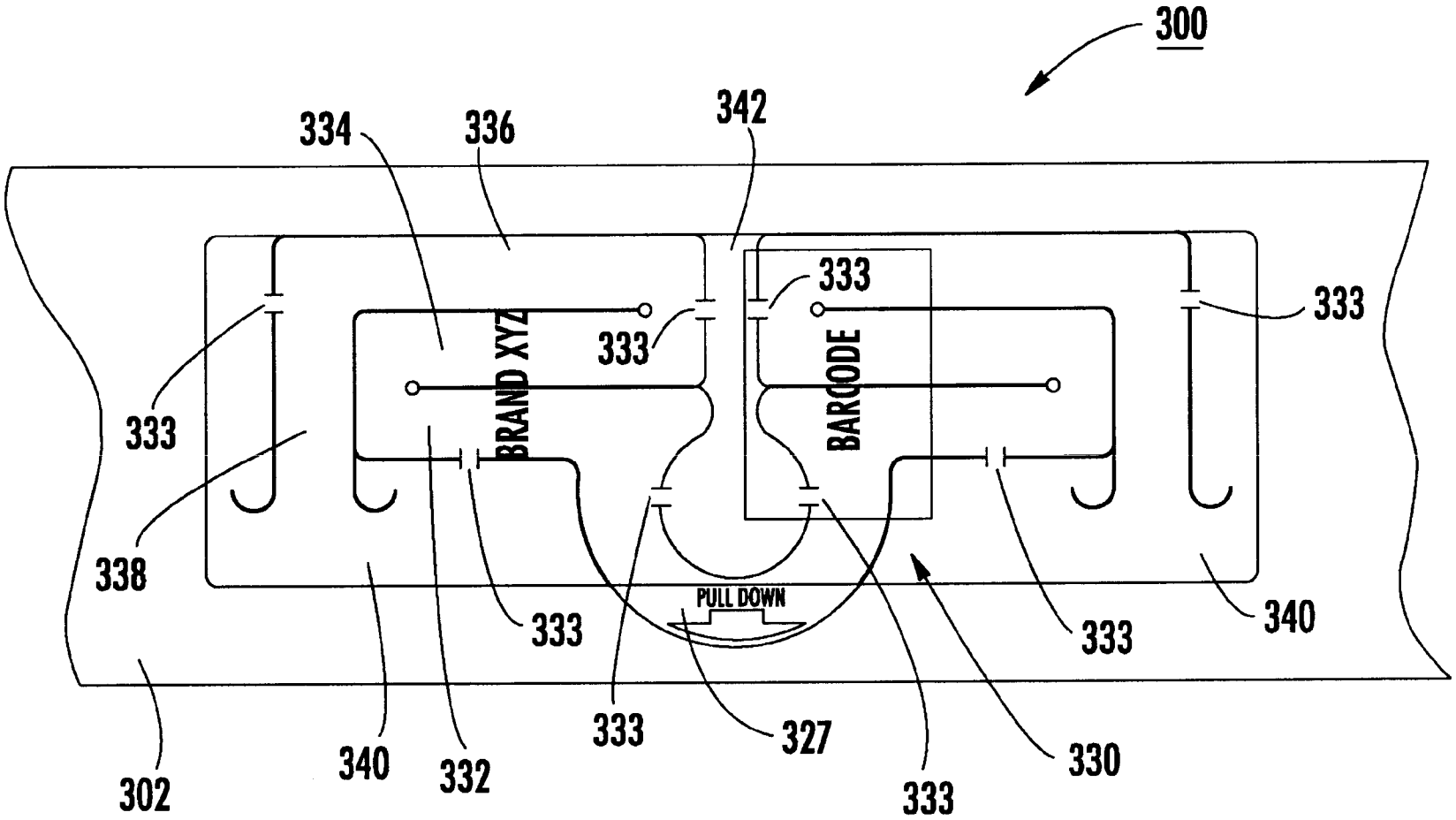
FIG. 10 is a top plan view of a label according to a further embodiment mounted on a release liner.

A label according to a further embodiment is shown in FIG. 10 on a release liner 302 and generally designated 300. The label 300 is constructed in the same manner as the label 100 except that a plurality of ties 333 are formed along the diecuts 323 between adjacent portions of the hanger strips 332, 338 and the attachment portions 340, between the hanger strips 334, 336 and the central portion 342, and between the loop 327 and the central portion 342. The ties 333 are formed such that they will break as the user pulls the hanger 330 downwardly. The ties 333 are formed during the diecutting step and extend down to the upper surface of the base label.

Optionally, in the label 300 as just described, the hanger member of the label 300 may be of a single ply construction as in the label 200. Optionally, the temporary adhesive coating the underside of the hanger 330 may be omitted or replaced with a deadened adhesive. Suitable methods for forming such labels will be apparent from U.S. Pat. No. 5,738,381.

According to further embodiments (not shown), a label according to the present invention may be formed as described with respect to the label 100 except that the temporary adhesive coating the underside of the hanger 130 may be omitted or replaced with a partially deadened adhesive. For example, the permanent adhesive 164 may coat the underside of the hanger 130 with a selected pattern of deadener applied to the underside of the adhesive. Additionally or alternatively, the adhesive may be deadened to make it low tack without rendering it non-tacky. Suitable methods for forming such labels will be apparent from U.S. Pat. No. 5,738,381. Additionally, the hanger member of such labels may be of a single ply construction as discussed with respect to the label 200.

Figure 11:
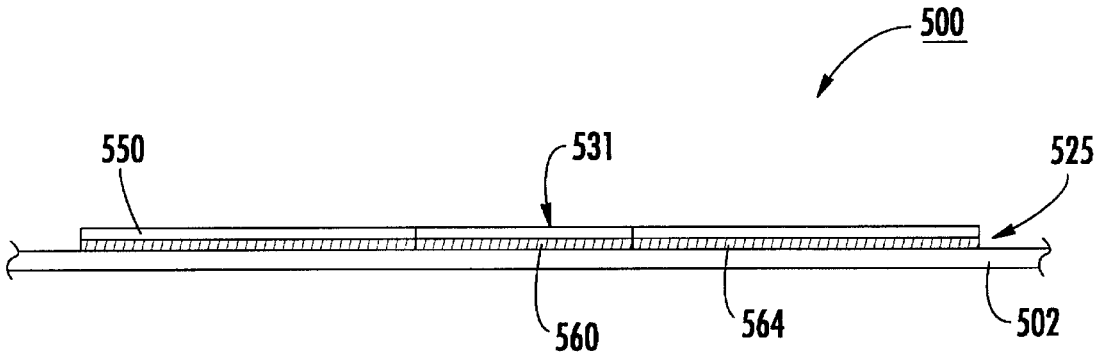
FIG. 11 is a side elevational view of a label according to a further embodiment mounted on a release liner.

A label 500 according to a further embodiment of the present invention is shown in FIG. 11 disposed on a release liner 502. In the label 500, the hanger member 525 includes a single ply layer 550 corresponding to the layer 150. The layer 550 is releaseably adhered to the release liner 502 by adhesive layers 564 and 560 corresponding to the adhesive layers 164 and 160, respectively. Thus, the label 500 does not include a base label corresponding to the base label 110. The hanger member 525 is diecut and configured in the same manner as the hanger member 125 except that the hanger member 525 is diecut down to the release liner 502. The adhesive layers 564 and 560 are applied in the same pattern as the adhesive layers 164 and 160 except that the temporary adhesive layer 160 preferably coats the entire undersurface of the pull tab 531. From the foregoing, it will be appreciated that such labels may be applied and used in manners similar to that discussed with respect to the label 100. However, in the case of the label 500, the adhesive layers 564 and 560 should be selected to be permanently and temporarily adherent, respectively, to the article to which the label 500 is to be applied, rather than to a base label material.

According to a further embodiment of the present invention (not shown), a label may be provided which is constructed in the same manner as the label 500 except having a multi-ply hanger member such as the multi-ply hanger member 125.

It will be appreciated that the combination of a hanger and a fugitive adhesive disposed on the undersurface of the hanger as discussed above may be used with hanger labels of designs and constructions different than those described and shown herein. For example, the fugitive adhesive may be applied to the rear surfaces of hangers of different shapes, including those shown in U.S. Pat. No. 5,738,381.

According to a further embodiment, the fugitive adhesive is replaced with a permanent adhesive, preferably an extension of the adhesive layer 164. However, in this case the lower surface of the hanger 130 is not fully coated with adhesive. Rather, only a selected pattern of the adhesive sufficient to temporarily hold the hanger 130 down is provided. Two preferred embodiments of this construction are discussed below.

Figure 12:
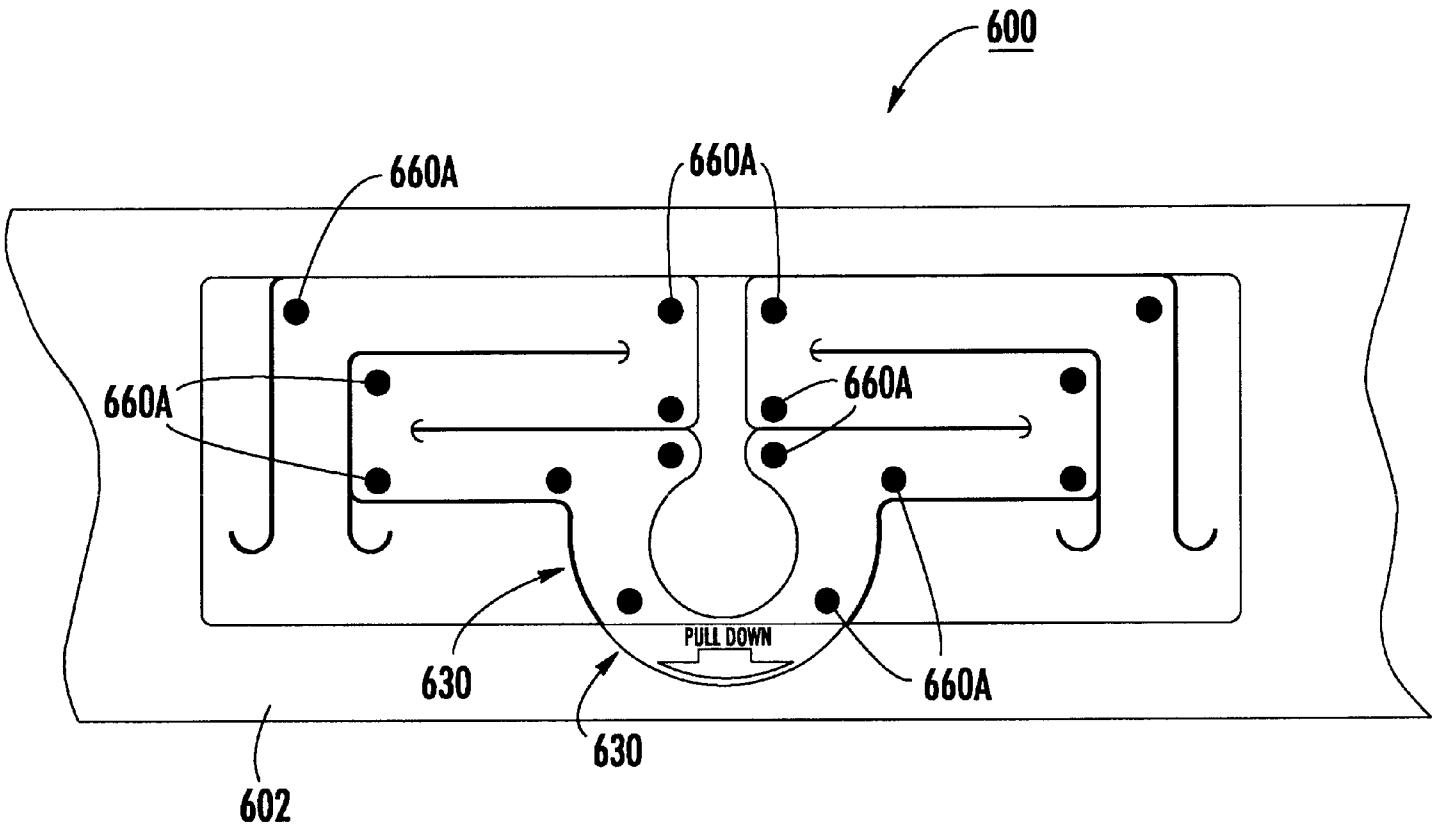
FIG. 12 is a top plan view of a label according to a further embodiment mounted on a release liner.

With reference to FIG. 12, a label 600 is shown therein on a release liner 602. The label 600 corresponds to the label 100 except that instead of having a coating of fugitive adhesive on the underside of the hanger 630, dots 660A of permanent adhesive are provided at strategic points on the underside of the hanger 630. The adhesive dots 660A temporarily hold the hanger 630 to the base label or the article (if the base label is omitted as in the label 500).

Figure 13:
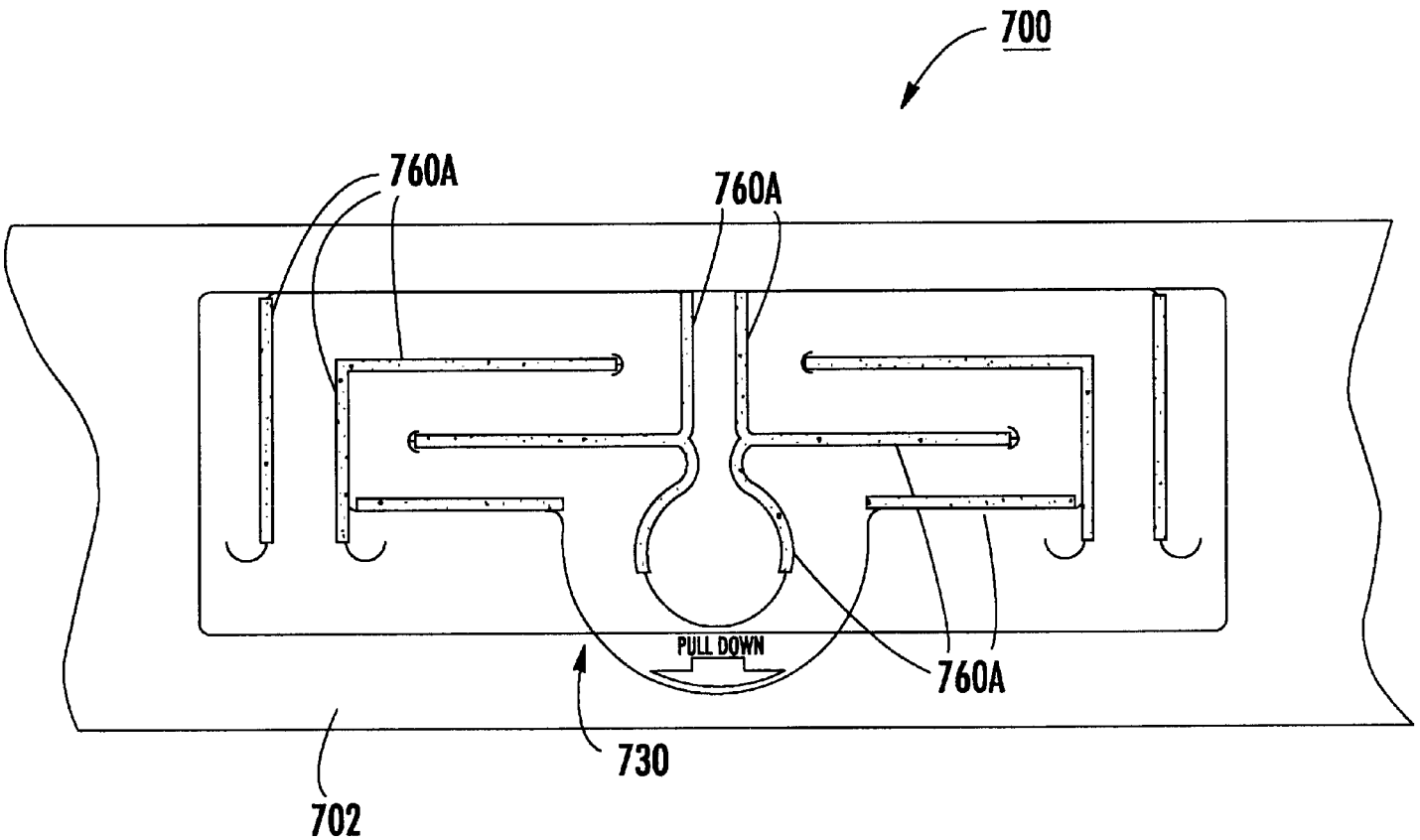
FIG. 13 is a top plan view of a label according to a further embodiment mounted on a release liner.

With reference to FIG. 13, a label 700 is shown therein on a release liner 702. The label 700 corresponds to the label 100 except that instead of having a coating of fugitive adhesive on the underside of the hanger 730, strips 760A of permanent adhesive are provided on the underside of the hanger 730 adjacent the edges thereof (i.e., along the die cuts). The adhesive strips 760A temporarily hold the hanger 730 to the base label or the article (if the base label is omitted as in the label 500).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A hanger label for use with an intended substrate and a support, said hang label comprising:

a) a hanger member including:
an attachment portion having a lower surface; and
a hanger portion having a lower surface, said hanger portion defining an opening adapted to receive the support;

b) a first, permanent adhesive coating said lower surface of said attachment portion to substantially permanently adhere said attachment portion to the substrate; and c) a second, non-permanent adhesive coating said lower surface of said hanger portion to temporarily adhere said hanger portion to the substrate.

2. The hanger label of claim 1 wherein said second adhesive is a fugitive adhesive.

3. The hanger label of claim 2 wherein said first adhesive is a pressure sensitive adhesive.

4. The hanger label of claim 1 wherein said hanger portion includes at least two legs, each of said legs having an end connected to said attachment portion such that, when said hanger label is adhered to the substrate, said legs are foldable away from the substrate about said attachment portion.

5. The hanger label of claim 1 wherein said hanger portion includes two plies adhered to one another by a third adhesive disposed therebetween.

6. A hanger label for use with a support, said hanger label comprising:

a) a base label having upper and lower surfaces;

b) a hanger member including:
an attachment portion having a lower surface; and
a hanger portion having a lower surface, said hanger portion defining an opening adapted to receive the support;

c) a first, permanent adhesive substantially permanently adhering said lower surface of said attachment portion to said upper surface of said base label;

d) a second, non-permanent adhesive temporarily adhering said lower surface of said hanger portion to said upper surface of said base label.

7. The hanger label of claim 6 including a base adhesive coating said lower surface of said base label.

8. The hanger label of claim 6 including indicia disposed on said upper surface of said base label.

9. The hanger label of claim 6 wherein said second adhesive is a fugitive adhesive.

10. The hanger label of claim 9 wherein said first adhesive is a pressure sensitive adhesive.

11. The hanger label of claim 6 wherein said hanger portion includes at least two legs, each of said legs having an end connected to said attachment portion such that said legs are foldable away from said base label about said attachment portion.

12. The hanger label of claim 6 wherein said hanger portion includes two plies adhered to one another by a third adhesive disposed therebetween.

13. A hanger label for use with an intended substrate and a support, said hanger label comprising:

a) a hanger member including:
an attachment portion having a lower surface; and
a hanger portion having a lower surface, said hanger portion defining an opening adapted to receive the support;

b) a first, permanent adhesive coating said lower surface of said attachment portion to substantially permanently adhere said attachment portion to the substrate;

c) a second, permanent, patterned adhesive partially coating said lower surface of said hanger portion to temporarily adhere said hanger portion to the substrate, a portion of said lower surface of said hanger portion being adhesive-free.

14. The hanger label of claim 13 wherein said patterned adhesive includes a plurality of spaced apart dots of permanent adhesive distributed along said lower surface of said hanger portion.

15. The hanger label of claim 13 wherein said patterned adhesive includes at least one strip of permanent adhesive extending along an edge of said hanger portion.

16. The hanger label of claim 13 including a base label having upper and lower surfaces, and wherein said second, permanent, patterned adhesive temporarily adheres said hanger portion to said upper surface of said base label.

17. The hanger label of claim 13 wherein said first and second adhesives are pressure sensitive adhesives.

18. The hanger label of claim 13 wherein said hanger portion includes at least two legs, each of said legs having an end connected to said attachment portion such that, when said hanger label is adhered to the substrate, said legs are foldable away from the substrate about said attachment portion.

19. The hanger label of claim 13 wherein said hanger portion includes two plies adhered to one another by a third adhesive disposed therebetween.

20. A hanger label for use with a substrate, said hanger label comprising:

a) a hanger member including:
an attachment portion having a lower surface; and
a hanger portion defining an opening adapted to receive the support and comprising:
an end connected to said attachment portion; and
a plurality of interconnected, folded strips connected to said end; and b) adhesive coating said lower surface of said attachment portion to adhere said attachment portion to the substrate;

c) wherein said hanger label is arranged and configured such that, when said hanger portion is pulled in a prescribed pull direction, said strips unfold and said hanger portion folds about said end to form a fold line substantially perpendicular to said pull direction.

21. The hanger label of claim 20 wherein said hanger portion includes first and second spaced apart ends and, when said hanger portion is pulled in said prescribed pull direction, said hanger portion folds about each of said first and second ends to form a respective said fold line substantially perpendicular to said pull direction.

22. The hanger label of claim 20 wherein said adhesive is a pressure sensitive adhesive.

23. The hanger label of claim 20 wherein said hanger portion includes two plies adhered to one another by a third adhesive disposed therebetween.

24. A method for suspending an article from a support, the article having an upper end and a lower end, said method comprising the steps of:

providing a hanger label comprising:
a hanger member including:
an attachment portion having a lower surface; and
a hanger portion defining an opening adapted to receive the support and comprising:
an end connected to the attachment portion; and
a plurality of interconnected, folded strips connected to the end;

securing the hanger label to the article;

pulling the hanger portion to unfold the strips and to fold the hanger portion about the end to form a fold line between the hanger portion and the attachment portion;

placing the hanger portion over the support such that the support is received in the opening; and positioning the hanger label relative to the support such that the fold line is substantially perpendicular to vertical.

25. The method of claim 24 wherein:

the hanger portion includes first and second spaced apart ends;

said step of pulling the hanger portion includes folding the hanger portion about each of the first and second ends to form a respective fold line between the hanger portion and the attachment portion at each end; and said step of positioning the hanger label includes positioning the hanger label such that each of the fold lines is substantially perpendicular to vertical.

26. The method of claim 24 wherein said step of pulling the hanger portion includes pulling the hanger portion toward an end of the article which becomes the upper end of the article when the article is suspended from the support using the hanger label.

* * * * *